United States Patent [19]

Groves

[11] 4,014,145

[45] Mar. 29, 1977

[54] ROOF SADDLE

[76] Inventor: John L. Groves, 5260 N. Genesee Road, Flint, Mich. 48506

[22] Filed: Feb. 19, 1976

[21] Appl. No.: 659,550

[52] U.S. Cl. ..... 52/199; 52/13

[51] Int. Cl.[2] ..... E04D 13/40; E04B 7/00

[58] Field of Search ..... 52/11–16, 52/41–44, 198, 199, 533

[56] References Cited

UNITED STATES PATENTS

| | | | |
|---|---|---|---|
| 465,064 | 12/1891 | Loomis | 52/13 |
| 1,951,090 | 3/1934 | Goodrich | 52/13 X |
| 2,210,599 | 8/1940 | Percy | 52/13 X |
| 2,619,920 | 12/1952 | Lindquist | 52/13 X |
| 2,780,184 | 2/1957 | Olsson | 52/15 |
| 3,090,162 | 5/1963 | Baroni | 52/13 X |

FOREIGN PATENTS OR APPLICATIONS

| | | | |
|---|---|---|---|
| 2,127,508 | 1/1973 | Germany | 52/198 |

*Primary Examiner*—J. Karl Bell
*Attorney, Agent, or Firm*—Clarence A. O'Brien; Harvey B. Jacobson

[57] ABSTRACT

First and second sets of panels of fiberboard or mineral board material are provided. The first set of panels are of constant thickness and rectangular in plan shape, and the other set of panels are also rectangular in plan shape but taper transversely in thickness from one longitudinal edge toward the opposite longitudinal edge. The constant thickness and tapering panels are disclosed in predetermined positions in order to form a saddle of full, half or quarter diamond-shaped plan area and with certain of the panels being trimmed and disposed in superposed relation whereby the upper surface of each quarter diamond-shaped saddle section will be planar and inclined. A pair of quarter diamond sections being used to form a saddle of one-half diamond plan shape and four quarter diamond sections being used to form a full saddle of full diamond plan shape.

9 Claims, 10 Drawing Figures

ROOF SADDLE

BACKGROUND OF THE INVENTION

When a flat roof is constructed and provided with peripheral or central drain openings or a slanted roof construction is provided including drain openings spaced along below zones of the slanted roof construction, roof saddles are often utilized to reduce the tendency of puddling of water on the roof in areas spaced from the drain openings. However, the present method of forming a roof saddle on a roof involves the molding of the saddle from light weight concrete, asphalt fill or other commonly used materials and requires three to four hours time. Light weight concrete saddles must dry before the final roofing material may be placed over the saddle, inasmuch as moisture beneath the roofing material is a negative factor in such roofing and is generally not allowed. Also, when molded roof saddles are utilized, they must be each molded in place on the particular roof on which it is to be used. Therefore, there is no way to standardize the manner in which molded roof saddles of different sizes may be constructed.

Roof structures including some of the general structural and operational features of the instant invention are disclosed in U.S. Pat. Nos. 853,897, 1,951,090, 2,160,642, 2,805,631, and 3,090,162.

BRIEF DESCRIPTION OF THE INVENTION

The roof saddle of the instant invention is composed of two sets of panels with the panels of the first set being rectangular in plan shape and constant in thickness and the panels of the second set being also of rectangular plan shape but tapered from one longitudinal marginal edge toward the other longitudinal marginal edge. The sets of panels are arranged in position on a roof surface so as to define a quarter, one-half or full saddle of diamond-shaped plan area and each quarter diamond-shaped roof saddle section includes an upper surface which is substantially planar and inclined relative to the undersurface of the saddle section. The quarter diamond saddle sections are right triangular in configuration with a height approximately three times its base and the slanted planar upper surface of the quarter diamond saddle section is slanted upwardly toward the intersection of the height and base edges thereof.

The main object of this invention is to provide a roof saddle which may be readily fabricated by utilizing two different sets of panels and which may be readily formed into quarter, half and full diamond-shaped roof saddles.

Another object of this invention is to provide a roof saddle of light weight construction.

Yet another object of this invention is to provide a roof saddle which may be readily varied in size according to the size of roof saddle needed.

Still another important object of this invention is to provide a roof saddle of standard sizes.

Another very important object of this invention is to provide a roof saddle which may be readily constructed by roofers utilizing materials familiar to them.

A further object of this invention is to provide a roof saddle whose slanted upper surface or surfaces will be of uniform inclination.

A final object of this invention to be specifically enumerated herein is to provide a roof saddle which will conform to conventional forms of manufacture, be of simple construction and easy to fabricate so as to provide a device that will be economically feasible, long lasting and relatively trouble free in fabrication.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 4 is an enlarged fragmentary transverse vertical sectional view illustrating the manner in which the various panels of the saddle illustrated in FIG. 2 are adhered to the roof and each other by means of hot asphalt or the like;

DETAILED DESCRIPTION OF THE INVENTION

Figure 1:
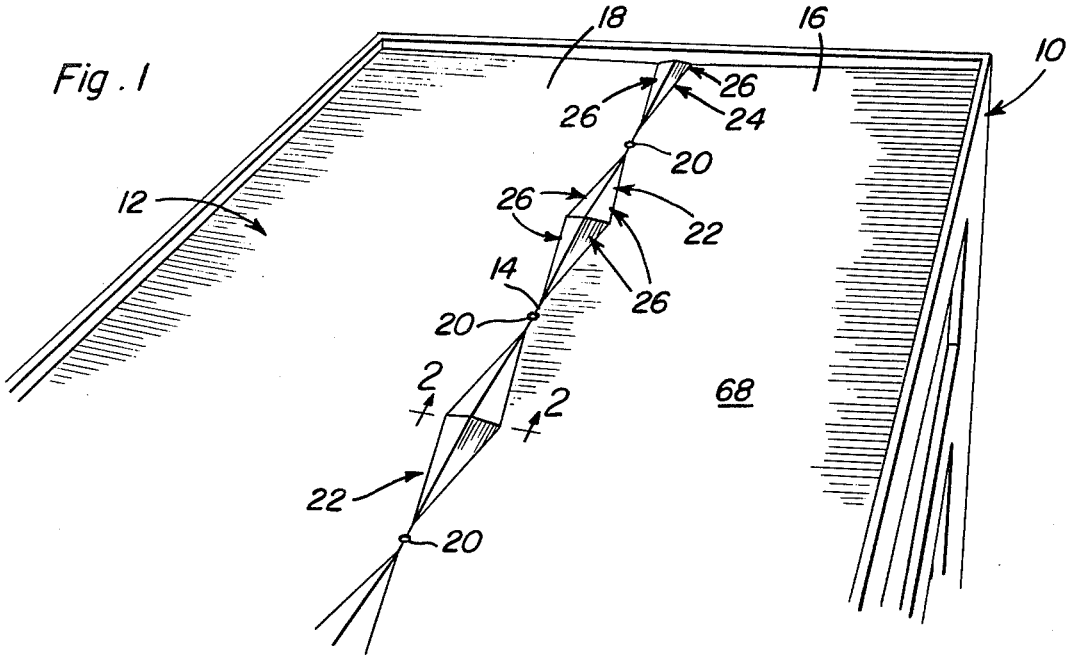
FIG. 1 is a fragmentary perspective view of the upper portion of a building utilizing a roof structure which slopes toward the longitudinal center line of the roof structure and which employs several of the roof saddles of the instant invention.
Figure 2:
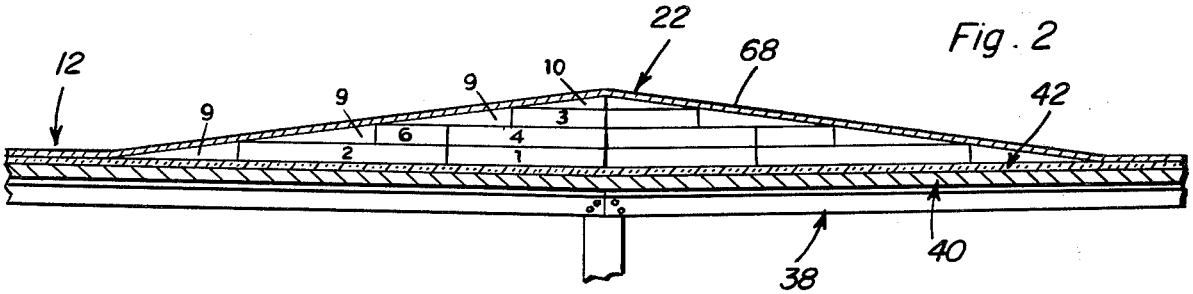
FIG. 2 is an enlarged fragmentary vertical sectional view taken substantially upon the plane indicated by the section line 2—2 of FIG. 1.

Referring now more specifically to the drawings, the numeral 10 generally designates a building including a roof structure referred to in general by the reference numeral 12. The roof structure 12 includes a longitudinal center line 14 toward which the opposite side sections 16 and 18 of the roof structure 12 slant. The roof structure 12 includes a plurality of upwardly opening drains 20 spaced along the center line and a plurality of roof saddles referred to in general by the reference numerals 22 and 24 are fabricated on the roof structure 12.

With attention invited now more specifically to FIGS. 2 and 5–7, it will be seen that the roof saddles 22 and 24 are constructed of quarter diamond-shaped sections referred to in general by the reference numeral 26. The roof saddle 24 includes two sections 26 and the saddles 22 include four sections 26.

Figure 8:
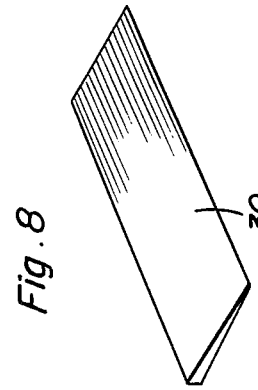
FIG. 8 is a perspective view of one of the tapered panels utilized in the construction of the roof saddle.
Figure 7:
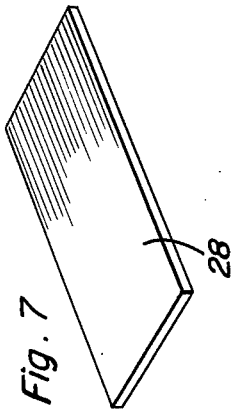
FIG. 7 is a perspective view of one of the constant thickness panels utilized in the construction of the roof saddle.

The saddle sections 26 are constructed of a plurality of first panels 28 and a plurality of second panels 30, see FIGS. 7 and 8. The panels 28 may be conveniently 24 inches in width and 48 inches in length. In addition, the panels 28 are approximately 1½ inches in thickness and may be constructed of fiberboard or mineral board material. The panels 28 are rectangular in configuration. Also, it may be seen from FIG. 8 that the panels 30 are rectangular in plan shape. The panels 30 are approximately 18 inches in width and 48 inches long. Further, the panels 30 taper in thickness from 1½ inches thick along one longitudinal edge to a feather edge extending along the other longitudinal side of the panel 30.

Figure 9:
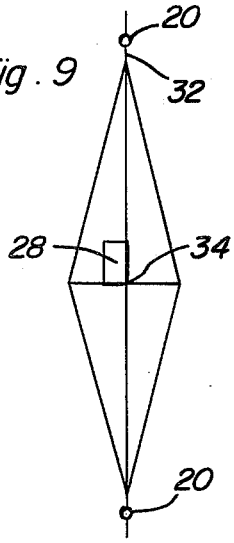
FIG. 9 is a plan view illustrating the manner in which the roof illustrated in FIG. 1 is initially marked in preparation to fabricating the roof saddles thereon.

In order to form a saddle 22 on the roof structure 12, a chalk line 32 is formed between adjacent drains 20, see FIG. 9. Then the longitudinal center of line 32 is marked at 34 and the precut panels 28 and 30 are laid out in a bottom layer referred to in general by numeral 36, see FIG. 5. The panels numbered 1–6 in the layer 36 comprise panels 28 and the panels numbered 7–9 in layer 36 are formed from the panels 30. The roof structure 12 includes an underlying structural support referred to in general by the reference numeral 38, a roof deck referred to in general by the reference numeral 40 and an insulation layer referred to in general by the reference numeral 42 initially has a layer of hot asphalt 44 applied thereto in the area of the roof structure 12 in which a saddle is to be formed. Then, the layer 36 of the panels 28 and 30 is applied over the hot asphalt in a manner such that at least some of the hot asphalt 44 is squeezed upwardly between adjacent panels 28 and 30. Thereafter, the first layer 36 has hot asphalt 44 disposed thereover and a second layer referred in general by the reference numeral 46 of panels 28 and 30 is applied over the first layer 36. The panel sections numbered 4–6 in the layer 46 are constructed of the panels 28 and the panels numbered 7–9 in the layer 46 are constructed of the panels 30. After the layer 46 has been applied, a third layer referred to in general by the reference numeral 48 is applied over the layer 46 subsequent to its being covered by hot asphalt 44 and the panels numbered 3 in the layer 48 are constructed of the panels 28 and the panels numbered 7, 8, 9, 11 and 12 are constructed of the panels 30. After the layer 48 has been covered by hot asphalt 44, the final layer referred to in general by the reference numeral 50 including panels numbered 10 and constructed of the panels 30 is applied over the layer 48.

Figure 4:
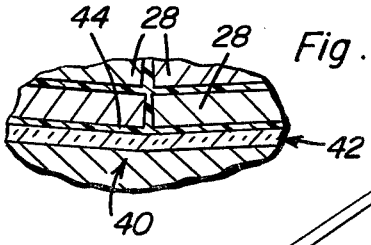

In constructing the roof saddles 28 at the opposite ends of the roof 12 one-half diamond saddles are fabricated using the layers 36, 46, 48 and 50 of FIG. 4. However, in constructing the roof saddles 22, a pair of half saddle sections are used.

Figure 10:
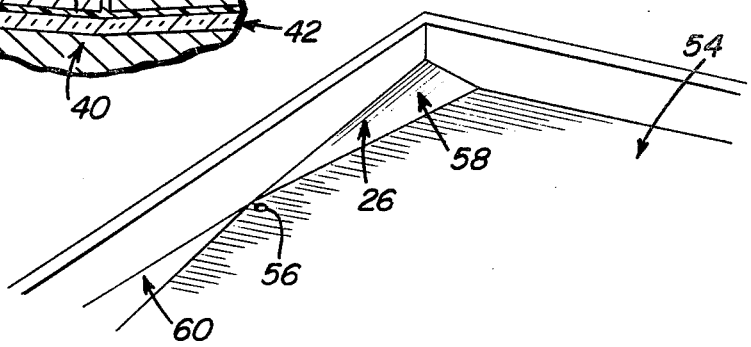
FIG. 10 is a fragmentary perspective view of a roof structure of the type which slants toward the longitudinal side edges of the roof and utilizes quarter and half diamond saddle sections.

Referring now more specifically to FIG. 10 of the drawings, there may be seen a second roof structure referred to in general by the reference numeral 54 which inclines toward the opposite side marginal edges thereof and includes side marginal edge drains 56. When applying roof saddles to the roof structure 54 quarter saddle sections referred to in general by the reference numeral 58 and half saddle sections referred to in general by the reference numeral 60 are used. Of course, the half saddle sections 60 differ from the half saddle sections comprising the roof saddles 24 in that the half saddle sections 60 comprise half sections resulting from constructing only one side of a saddle 22 while the saddle 24 is a result of constructing only one end of the saddle 22.

Figure 3:
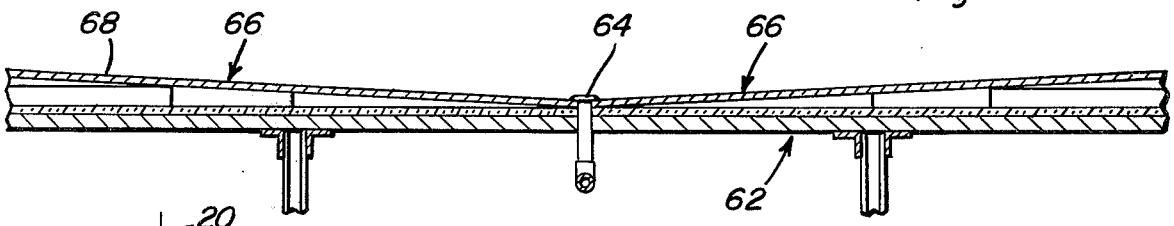
FIG. 3 is a fragmentary longitudinal sectional view illustrating the manner in which adjacent roof saddles may be utilized upon a flat roof structure.

With attention now invited more specifically to FIG. 3 of the drawings, there may be seen a roof structure referred to in general by the reference numeral 62. The roof structure 62 is substantially flat but includes a plurality of upwardly opening drains 64 corresponding to the drains 20 and between which roof saddles referred to in general by the reference numeral 66 and corresponding to the roof saddles 22 are fabricated.

After each roof saddle has been fabricated, the flexible roofing material 68 is applied over the saddles and the insulation 42.

If it is desired to apply the saddles to a roof during a re-roofing operation, the old roof structure must be perforated before the saddles and the new roofing 68 may be applied thereover.

Figure 5:
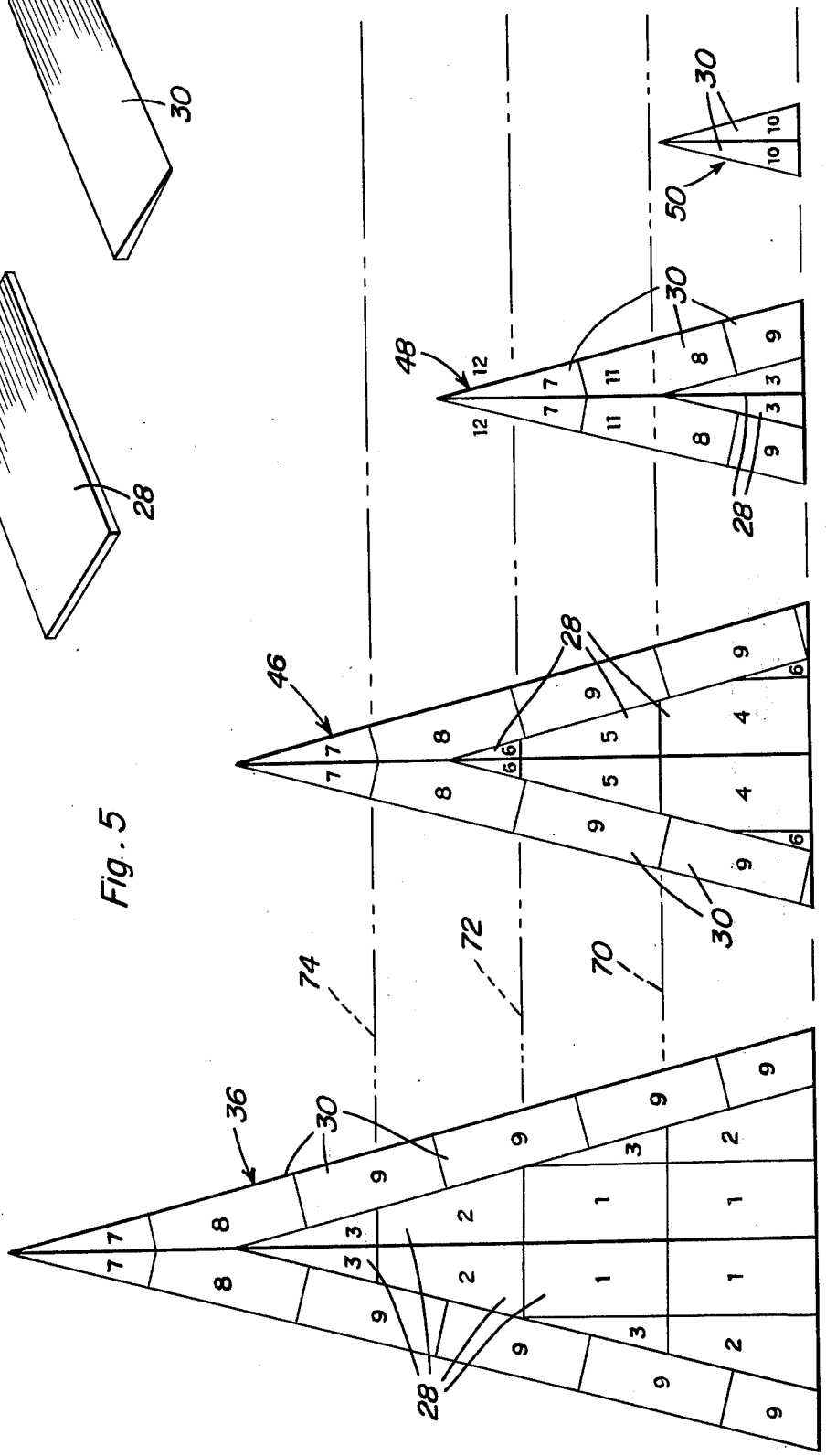
FIG. 5 is a horizontally exploded plan view of four plies of a one-half diamond saddle and illustrating the manner in which each layer of panels of the half diamond saddle are arranged relative to each other.
Figure 6:
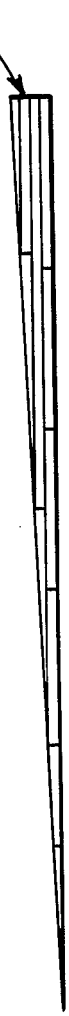
FIG. 6 is a side elevational view of a quarter diamond roof saddle section.

The layer 36 of FIG. 5 comprises the lower layer of one-half of a roof saddle which is 44 feet in length. If a roof saddle 36 feet in length is desired, only the layers 36, 46 and 48 are used and these layers are trimmed at the line 70 in FIG. 5. Still further, if a roof saddle of only 28 feet in length is desired, the layers 36, 46 and 48 are trimmed at the line 72 in FIG. 5 and if a roof saddle of only 20 feet in length is desired only the layers 36 and 46 are used and those layers are trimmed at the line 74 in FIG. 5.

As hereinbefore set forth, the panels 28 may be constructed of fiberboard or mineral board and the panels 30 are constructed of fiberboard. Further, the panels 28 and 30 are of 15 pound density.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. In combination, a roof structure including an upper surface, a plurality of upwardly opening drain openings spaced apart in a straight line extending along the roof, a roof saddle including at least one section of triangular plan shape including base, height and slant height edges with said base and height edges disposed at generally right angles relative to each other, a plurality of first constant thickness panels and second panels of tapering thickness positioned on said roof and disposed in superposed relation to define a generally planar upper surface inclined upwardly away from the upper surface of said roof structure toward the juncture between the base and height edges of said saddle, said height edge being disposed along said line and the apex of said height and slant height edges projecting toward and disposed adjacent one of said drain openings, and flexible roof sheeting secured over said saddle and adjacent upper surface portions of said roof.

2. The combination of claim 1 wherein said roof structure upper surface is substantially flat.

3. The combination of claim 1 wherein said roof structure upper surface is inclined toward said line.

4. The combination of claim 1 wherein said roof structure includes a pair of oppositely inclined roof sections on opposite sides of and inclined downwardly toward said line, said saddle including four sections of right triangular plan shape disposed with their right angle corners spaced about a center point on said line and with the planar upper surfaces of said section all inclined upwardly toward a central apex.

5. The combination of claim 1 wherein said roof structure includes a pair of oppositely inclined roof sections on opposite sides of and inclined downwardly toward said line, said roof including a marginal edge disposed transverse to said line, said saddle including two saddle sections of right triangular plan shape with their height edges opposing each other and extending along said line, said sections disposed on opposite sides of said line and the base edges, extending along said roof marginal edge transverse to said line.

6. The combination of claim 1 wherein said roof structure includes a first marginal edge along which said line extends and a second marginal edge extending transverse to said line and disposed at one end of said line, said saddle including a single saddle section disposed in the corner of said roof defined by the intersection of said first and second marginal edges with said height and base edges extending along said first and second marginal edges, respectively.

7. The combination of claim 1 wherein said roof structure includes a first marginal edge along which said line extends, said saddle being disposed between adjacent drains and including a pair of saddle sections disposed in base edge-to-edge abutting relation with the height edges thereof extending along said first marginal edge, said saddle being disposed between adjacent drain openings.

8. A roof saddle structure including at least one saddle section of right triangular plan shape, said section including a plurality of layers disposed in superposed relation each layer below the uppermost layer including a minor right triangular plan shaped zone of constant thickness and a slant height band extending along the slant height of the minor right triangular zone and tapering in thickness away from the slant height of the minor zone, each layer above a lower layer and below the uppermost layer having the upper surface of its slant height band coplanar with and forming an upper extension of the upper surface of the slant height band of the next lower layer.

9. The combination of claim 8 wherein the uppermost layer is right triangular in plan shape and tapers in thickness toward the slant height thereof, the upper surface of the uppermost layer forming an upper extension of the upper surface of the slant height band of the next lower layers.

* * * * *